US008075120B2

(12) United States Patent
Ide et al.

(10) Patent No.: US 8,075,120 B2
(45) Date of Patent: Dec. 13, 2011

(54) INK JET PRINT HEAD AND INK JET PRINTING APPARATUS

(75) Inventors: Shuichi Ide, Tokyo (JP); Ken Tsuchii, Sagamihara (JP); Arihito Miyakoshi, Tokyo (JP); Yasuhiko Osaki, Kawasaki (JP); Shuichi Murakami, Kawasaki (JP); Hiroshi Arimizu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 517 days.

(21) Appl. No.: 12/327,369

(22) Filed: Dec. 3, 2008

(65) Prior Publication Data

US 2009/0179939 A1 Jul. 16, 2009

(30) Foreign Application Priority Data

Dec. 7, 2007 (JP) ..... 2007-317230

(51) Int. Cl.
*B41J 2/19* (2006.01)

(52) U.S. Cl. ..... 347/92; 347/21; 347/28; 347/34

(58) Field of Classification Search ..... 347/92, 347/21, 28, 34
See application file for complete search history.

(56) References Cited

U.S. PATENT DOCUMENTS 4,520,366 A * 5/1985 Cragin, Jr. ..... 347/74
4,942,409 A * 7/1990 Paton et al. ..... 347/21
6,137,510 A 10/2000 Sato et al.
6,540,335 B2 4/2003 Touge et al.
6,719,398 B1 4/2004 McElfresh et al.
6,886,905 B2 * 5/2005 McElfresh et al. ..... 347/21
6,997,538 B1 2/2006 Kawamura et al.
7,246,873 B2 7/2007 Tsuchii
2008/0136872 A1 6/2008 Tsuchii et al.
2009/0040273 A1 2/2009 Tsuchii et al.
2009/0066752 A1 3/2009 Ide et al.
2009/0185001 A1 7/2009 Fukui et al.

* cited by examiner

*Primary Examiner* — Ellen Kim

(74) *Attorney, Agent, or Firm* — Fitzpatrick, Cella, Harper & Scinto

(57) ABSTRACT

An ink jet print head is capable of creating a state where the direction of ink-drop ejection is not likely to be influenced by air currents generated by the ink ejection, and is capable of printing an image without causing the shifting of dots. To this end, air currents generated by the ejection of ink and the interference among the air currents are reduced by blowing out gas in a direction parallel with the direction of the ink ejection. Accordingly, even with a print head that ejects, at high ejection frequency, ink from multiple ejecting openings formed densely, the advancing direction of the ink drops is unlikely to be deflected. As a consequence, a high-quality, uniform image can be outputted.

9 Claims, 12 Drawing Sheets

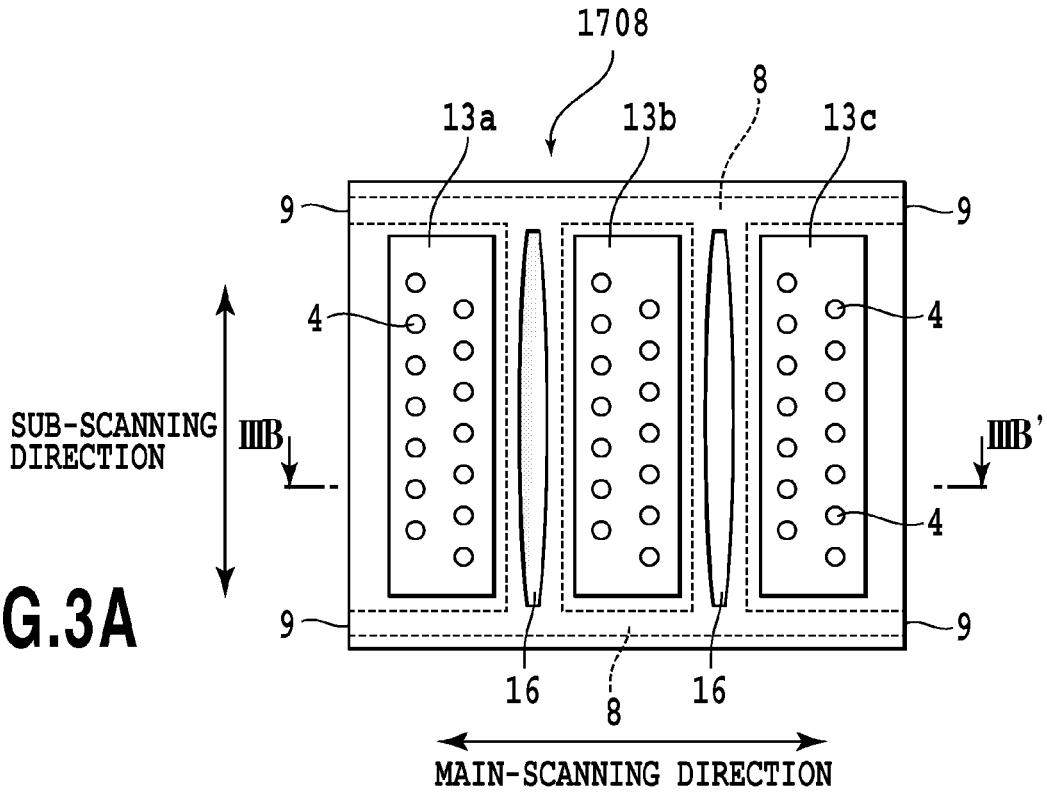
FIG.3A
FIG.3B
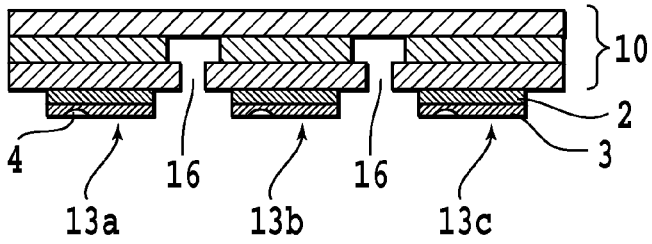

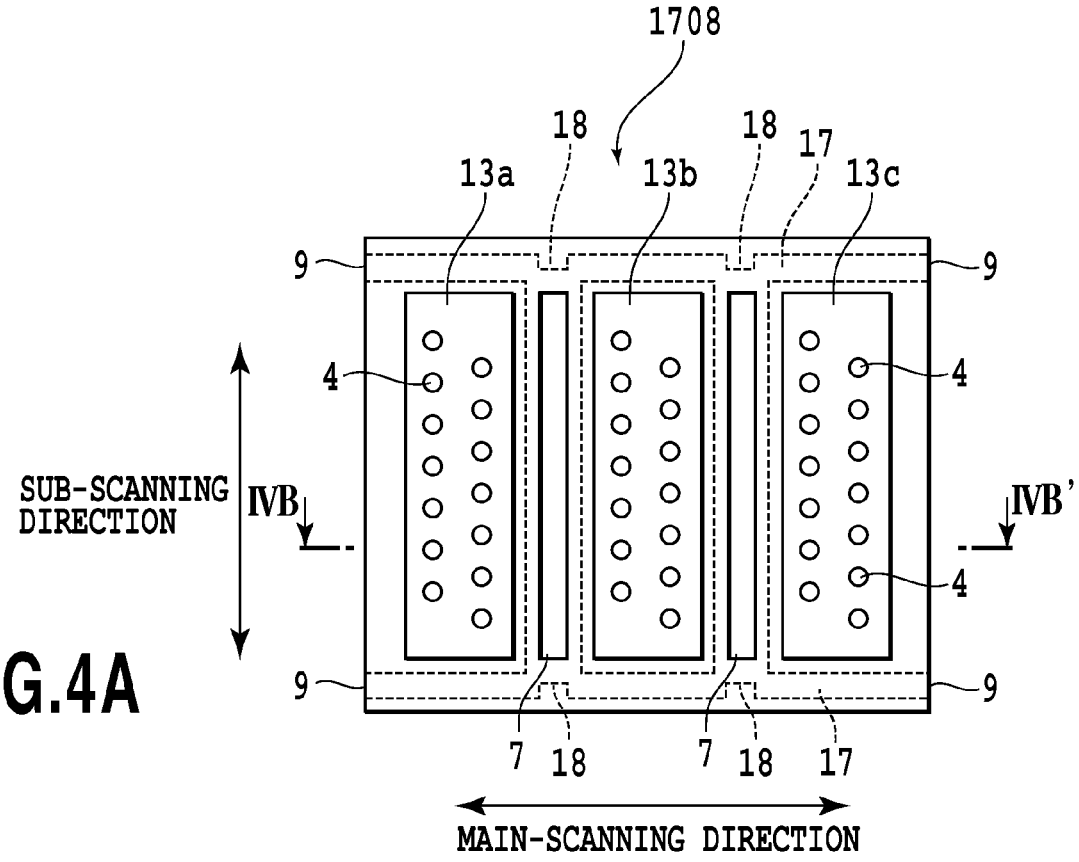
FIG.4A
FIG.4B
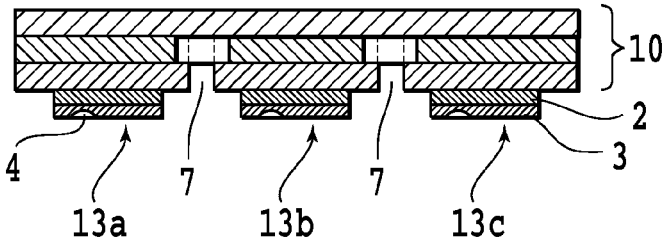

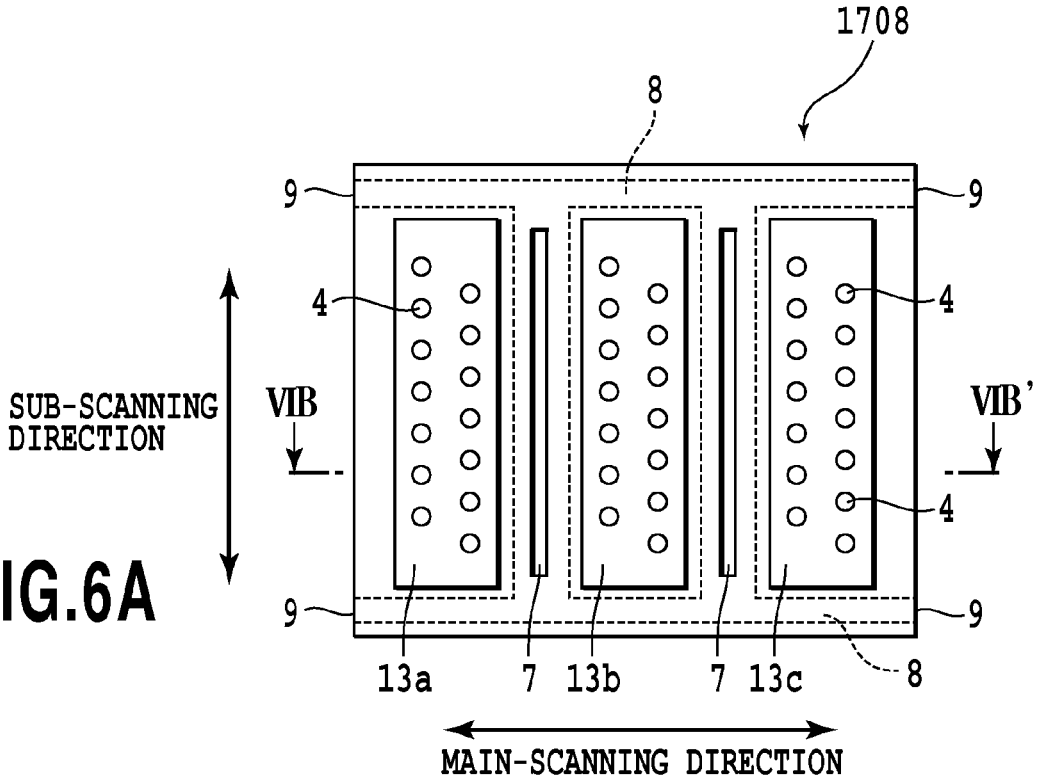
FIG.6A
FIG.6B
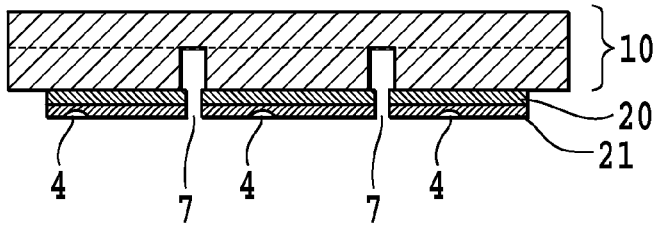

INK JET PRINT HEAD AND INK JET PRINTING APPARATUS

BACKGROUND OF THE INVENTION

1. Field of the Invention

The present invention relates to an ink jet print head that ejects ink according to an ink jet method, and also relates to an ink jet printing apparatus that performs printing on a print medium by using the ink jet print head. In particular, the present invention relates to a technique to reduce the generation of air current at the time of the ejecting operation of an ink jet print head that includes an array of plural ejecting opening columns.

2. Description of the Related Art

High-speed output, high-resolution printing, high quality of image, and low noise are some of the properties that are required for the various types of printing apparatuses having recently been developed. Ink jet printing apparatuses are examples of the printing apparatuses that can satisfy the above-mentioned requirements. In the ink jet printing apparatus, ink (printing liquid) drops are ejected from ejecting openings formed in the print head, and made to fly. Then the ink drop is attached on a print medium to form a dot at predetermined positions.

The ink jet printing apparatus is provided with means for generating energy to eject ink. An electrothermal transducing element such as a heater and a piezoelectric element are some of the examples of the above-mentioned energy generating means. Applying voltage to an electrothermal transducing element generates heat rapidly in the electrothermal transducing element to cause film boiling of the ink located nearby. The phase transition of the ink causes foam pressure, which makes the ink ejected, as drops, from the ejecting openings. On the other hand, applying voltage to a piezoelectric element causes a deformation of the piezoelectric element. Pressure generated at the time of the deformation makes the ink ejected, as drops, from the ejecting openings.

Incidentally, increasing demands for higher-speed and higher image quality of printing have caused changes related to the recent ink jet printing apparatuses. Apparatuses have now been developed that have an increased number or density of ejecting openings arrayed in the printing head, a reduced size of the ink drops, and an increased ejection frequency. Now, suppose a case where printing is performed by ejecting ink at high frequency from a printing head with a large number of ejecting openings that are densely arrayed. It is known that, in this case, multiple ink drops ejected at high speed sometimes cause air currents between the print head and the print medium, and that such air currents affect the direction in which the ink drops fly.

FIG. 9 is a schematic diagram for describing a case where the air currents affect the direction in which the ink is ejected. While a print head 100 shown in FIG. 9 moves, relative to a print medium P, in the main-scanning direction indicated in FIG. 9 at a predetermined speed, the print head 100 ejects ink drops 300 from ejecting opening columns 201 and 202 to the print medium P at a predetermined frequency. Each of the ejecting opening columns 201 and 202 includes an array of plural ejecting openings arranged in the vertical direction in the drawing. The ink drops ejected from the ejecting opening columns 201 and 202 at high speed and high frequency generate air currents 11 near the ejecting opening columns 201 and 202. The air currents 11 thus generated interfere with one another, which deflects the advancing direction of the ink drops 300 that would otherwise have been directed perpendicularly to the print medium P. Consequently, dots are printed on the print medium P at positions that are different from their respective originally-targeted positions. The degree of such deflection depends on the magnitude of the air currents, which in turn depends on the actual ejection frequency of the ink ejected from the individual ejecting opening columns 201 and 202, that is, on the data for the printing. Accordingly, the amount of shifting of the dots varies depending on the data for the printing. In the outputted image, the variable amount of shifting causes such recognizable image defects as unevenness in the density.

U.S. Pat. No. 6,997,538 and U.S. Pat. No. 6,719,398 disclose print heads that blow out gas as the ink is being ejected for the purpose of reducing the harmful effects of the above-described air currents on the outputted image.

FIGS. 10, and 11A to 11C are diagrams for describing the blowing out of gas at the time of printing disclosed either in U.S. Pat. No. 6,997,538 or U.S. Pat. No. 6,719,398. These documents explain that the air currents that deflect the ejecting direction of the ink are caused by the kinetic energy of the ink ejected at high frequency and at high speed as well as by the movement of the carriage at the time of printing. FIG. 10 illustrates an exemplar configuration to reduce the air currents. In the configuration, a gas blowing-out opening 70 is provided at the front side of the carriage in the direction in which the carriage is advancing. At the time of printing, the gas is blown out in a direction which is perpendicular to the ejecting direction of the ink and which is parallel with the scanning direction of the carriage. However, when plural ejecting opening columns are arranged side by side with one another in the advancing direction of the carriage, the effects obtained by the blowing out of the gas in the configuration of FIG. 10 may possibly differ among the plural ejecting opening columns. Specifically, the stream of the gas blown out is strong around the ejecting opening column located closer to the gas blowing-out opening 70, so that large effects of the blowing out of the gas can be expected. However, the stream of the gas blown out is weak around the ejecting opening column located farther away from the gas blowing-out opening 70, so that only small effects of the blowing out of the gas can be expected. It is certainly conceivable that a larger blowing-out power for the gas is employed in accordance with the necessity of affecting the ejecting opening column that is located farthest away from the gas blowing-out opening 70. In this case, however, the stream of the gas blown out with such a large blowing power may possibly affect, negatively, the ejecting direction of the ink from the ejecting opening columns located closer to the gas blowing-out opening 70.

In contrast to the configuration of FIG. 10, the configuration shown in FIGS. 11A to 11C includes a gas-introduction opening 90 and gas blowing-out openings 71 that are so arranged that the gas is blown out in a direction which is perpendicular to the ejecting direction of the ink and which is parallel to the ejecting opening columns. Multiple gas blowing-out openings 71 are provided at their respective positions each of which is located between two adjacent ones of the ejecting opening columns in the configuration shown in FIGS. 11A to 11C. Accordingly, even when the configuration includes multiple ejecting opening columns, the uneven effects on the plural ejecting opening columns can be avoided.

Both of the above-mentioned Patent Documents describe that the configuration to blow out the gas in a direction perpendicular to the ejecting direction of the ink makes it possible to reduce the air currents that are likely to deflect the ejecting direction of the ink.

Examination conducted by the inventors of the present invention has revealed that a gas blown out in a direction that is parallel with the ejecting direction of the ink, in some cases, stabilizes the ejecting direction of the ink better than a gas blown out in a direction that is perpendicular to the ejecting direction of the ink. In such cases, sufficient stabilizing effects on the ejecting direction of the ink cannot be obtained by a configuration in which the gas is blown out only in a direction that is perpendicular to the ejecting direction of the ink as disclosed in U.S. Pat. No. 6,997,538 or U.S. Pat. No. 6,719,398, and thus no satisfactory improvement in the problem of dot shifting can be observed.

SUMMARY OF THE INVENTION

The present invention is made to solve the above-described problem. Therefore, an object of the present invention is to provide an ink jet print head that is capable of making a print without dot shifting. To this end, the ink jet print head blows out a gas in a direction that is parallel with the ejecting direction of the ink, and thus creates a state in which the ejecting direction of the ink-drop is immune well from the influence of the air currents generated by the ink-drop ejection.

The first aspect of the present invention is an ink jet print head comprising: a plurality of ejecting opening groups arranged in the main-scanning direction that crosses a sub-scanning direction, each of the ejecting opening groups including ejecting openings which eject ink onto a print medium and which are arranged in the sub-scanning direction; and a gas blowing-out opening which is located between the adjacent ones of the plurality of ejecting opening groups and which blows out gas in a direction parallel with the direction of the ink ejection.

The second aspect of the present invention is an ink jet printing apparatus which prints an image on the print medium using the ink jet print head described above for printing an image on a print medium.

The above and other objects, effects, features and advantages of the present invention will become more apparent from the following description of embodiments thereof taken in conjunction with the accompanying drawings.

Further features of the present invention will become apparent from the following description of exemplary embodiments (with reference to the attached drawings).

BRIEF DESCRIPTION OF THE DRAWINGS

FIGS. 3A and 3B are diagrams for describing, in a similar way to the description for Example 1, the configuration of the ink jet print head used in Example 3 including: ejecting opening columns 13*a*, 13*b*, and 13*c* for three colors; gas blowing-out openings 16 provided nearby; and gas passage 8 for supplying gas to the gas blowing-out openings 16;

FIGS. 4A and 4B are diagrams for describing, in a similar way to the description for Example 1, the configuration of the ink jet print head used in Example 4 including: ejecting opening columns 13*a*, 13*b*, and 13*c* for three colors; gas blowing-out openings 7 provided nearby; and gas passage 17 for supplying gas to the gas blowing-out openings 7;

FIGS. 6A and 6B are diagrams for describing, in a similar way to the description for Example 1, the configuration of the ink jet print head used in Example 6 including: ejecting opening columns 13*a*, 13*b*, and 13*c* for three colors; gas blowing-out openings 7 provided nearby; and gas passage 8 for supplying gas to the gas blowing-out openings 7;

DESCRIPTION OF THE EMBODIMENTS

A preferred embodiment of the present invention will be described in detail below with reference to the accompanying drawings.

Figure 7:
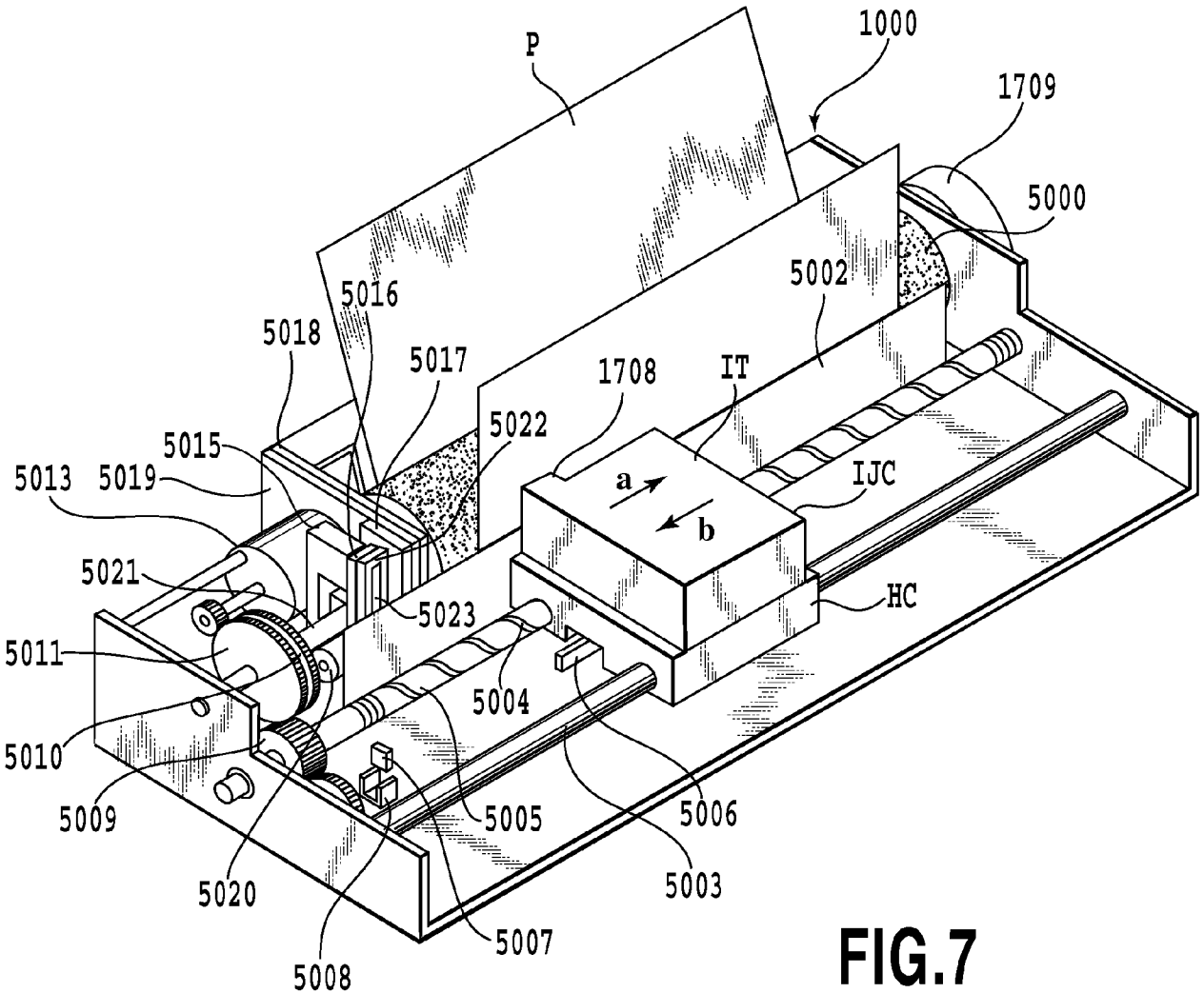
FIG. 7 is a perspective view of the external appearances illustrating the general configuration of an ink jet printing apparatus 1000 usable in an embodiment of the present invention.

FIG. 7 is a perspective view of illustrating the general configuration of an ink jet printing apparatus 1000 usable in the present invention. 5013 denotes a carriage motor. A lead screw 5005 is linked to the carriage motor 5013 by means of driving-force transmission gears 5009 to 5011, and rotates in accordance with the forward-and-reverse rotation of the carriage motor 5013. A spiral grove 5004 is formed in the lead screw 5005. A carriage HC that engage with the lead screw 5005 moves reciprocating in directions indicated by the arrow a and the arrow b in response to the forward-and-reverse rotation of the carriage motor 5013. The carriage HC is also supported by a guide rail 5003 that guides the carriage HC and that is provided in parallel with the lead screw 5005. Photocouplers 5007 and 5008 are provided to detect whether the carriage HC is present at its home position, and such detection is possible by checking whether a lever 5006 that is attached to the carriage HC cuts off the photocouplers 5007 and 5008. With the detection, the rotational direction of the carriage motor 5013 is switched.

An integrated-type ink jet cartridge IJC is mounted on the carriage HC, and contains a print head 1708 and an ink tank IT that supplies the print head 1708 with ink. Detailed description of the configuration of the print head 1708 will be given later.

A conveying motor 1709 conveys a print medium P in a sub-scanning direction that crosses the directions a and b. A predetermined amount of rotation of the conveying motor 1709 makes a conveying roller 5000 that is linked to the conveying motor 1709 to rotate. Since the conveying roller 5000 is in contact with the surface of the print medium P, the rotation of the conveying roller 5000 makes the print medium P conveyed in the sub-scanning direction by a predetermined amount. A paper pressing plate 5002 presses the print medium P along the direction in which the carriage HC moves. The print medium P corresponding to the printing portion is thus pressed against the conveying roller 5000. Accordingly, the distance between the print head 1708 and the printing portion of the print medium P is kept constant.

By alternating the printing operation in which the carriage HC is moved by the carriage motor 5013 and the conveying operation in which the print medium P is conveyed by the conveying motor 1709, an image is printed sequentially on the print medium P.

A cap member 5022 is provided to cover the ejecting opening face of the print head 1708 while being supported by a support member 5016. An in-the-cap opening 5023 is formed in the cap member 5022, through which the ink is sucked from the print head 1708 by a suction apparatus 5015 connected to the cap member 5022. The sucking operation is started by a movement of a lever 5021, and the movement of the lever 5021 is caused by a cam 5020 that engages with the carriage HC. Note that the movement of the lever 5021 can be controlled by means of a known mechanism that transmits the driving power of the carriage motor 5013 with a clutch switch or the like.

A blade 5017 is provided to clean the ejecting opening face of the print head 1708. A support member 5019 is a member that allows the blade 5017 to move in the front-to-rear direction. A main-body support plate 5018 supports the blade 5017 and the support member 5019. The blade 5017 is not necessarily the form described but a known cleaning blade may be used for the same purpose.

The capping operation, the sucking operation, and the cleaning can be done at their respective positions by the operation of the lead screw 5005 while the carriage HC is located near the home position thereof. Such a configuration should not be limited to the present invention. Any configuration can be employed as long as the configuration allows desired operations to be performed at known timings.

Figure 8:
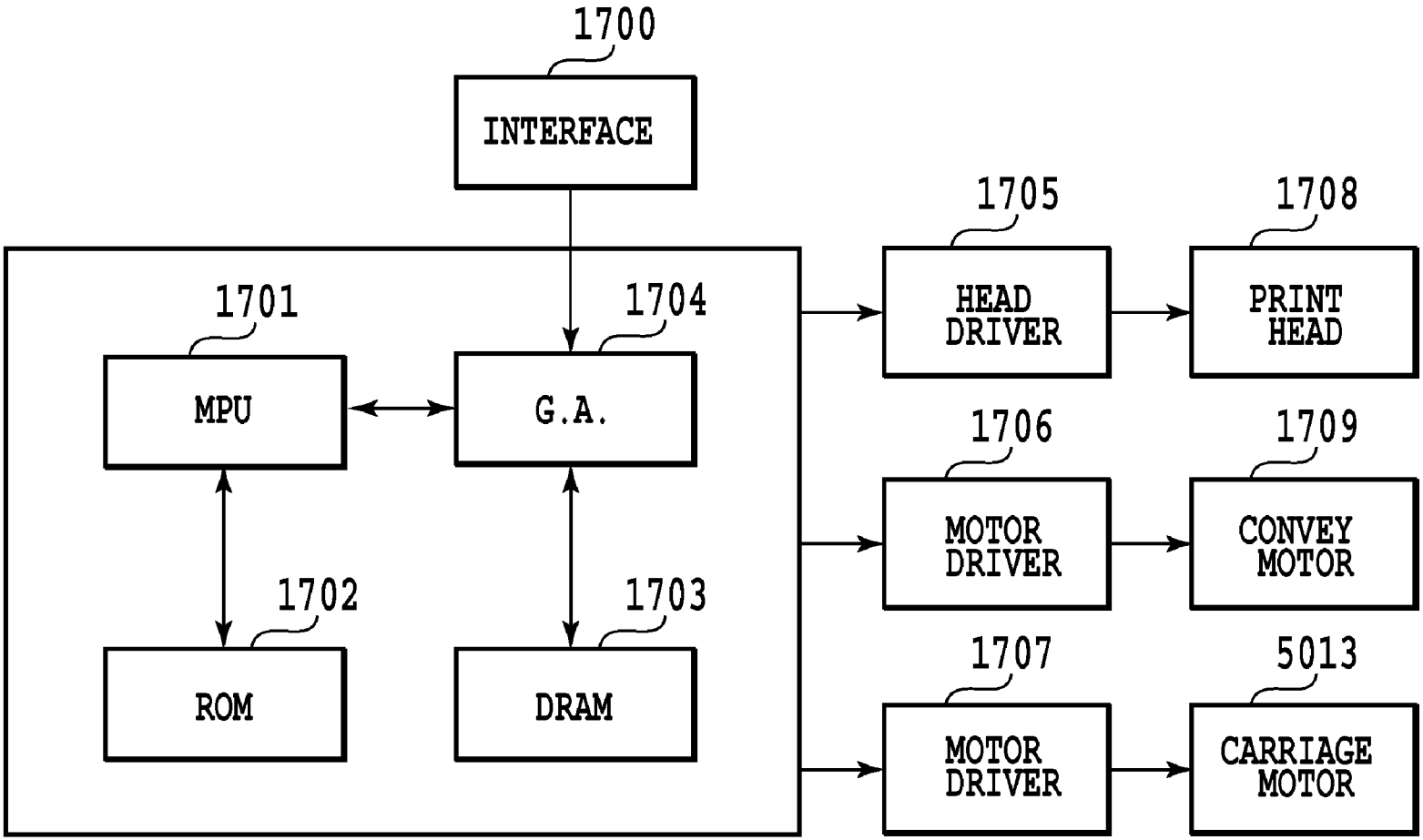
FIG. 8 is a block diagram illustrating the configuration for controlling an ink jet printing apparatus employed in an embodiment of the present invention.
Figure 9:
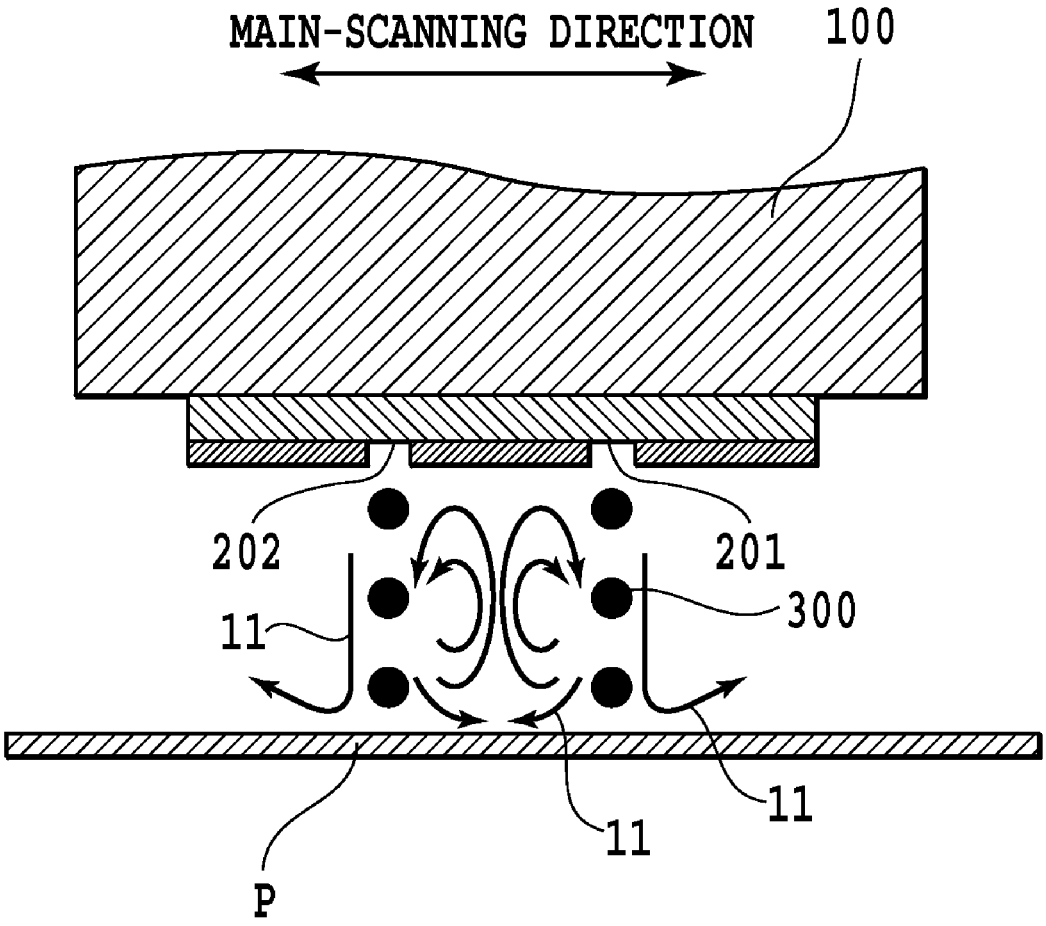
FIG. 9 is a schematic diagram for illustrating how air currents affect the ejecting direction of ink-drop.
Figure 10:
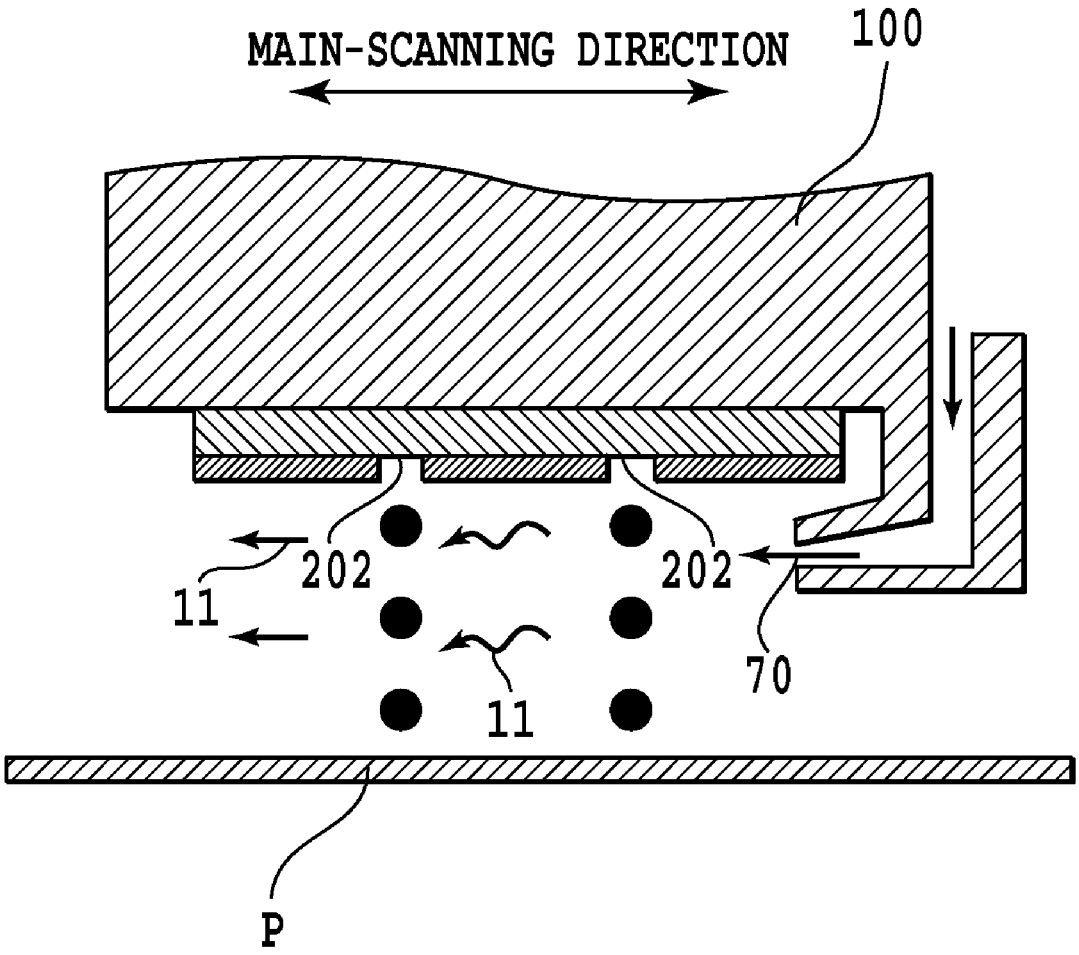
FIG. 10 is a diagram illustrating how gas is blown out at the time of printing disclosed in U.S. Pat. No. 6,997,538 or in U.S. Pat. No. 6,719,398.
Figure 11A:
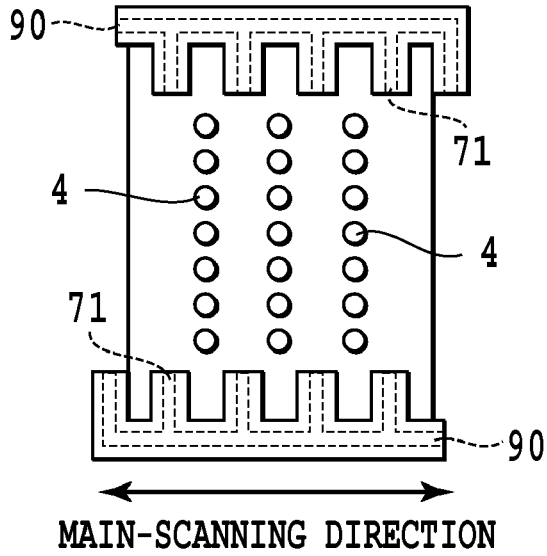
FIGS. 11A to 11C are diagrams illustrating how gas is blown out at the time of printing disclosed in U.S. Pat. No. 6,997,538 or in U.S. Pat. No. 6,719,398.
Figure 11B:
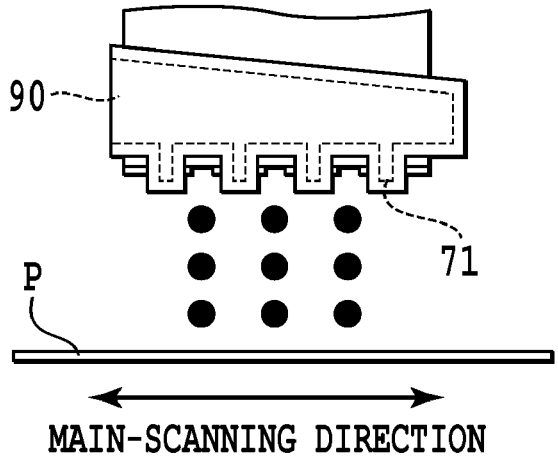
Figure 11C:
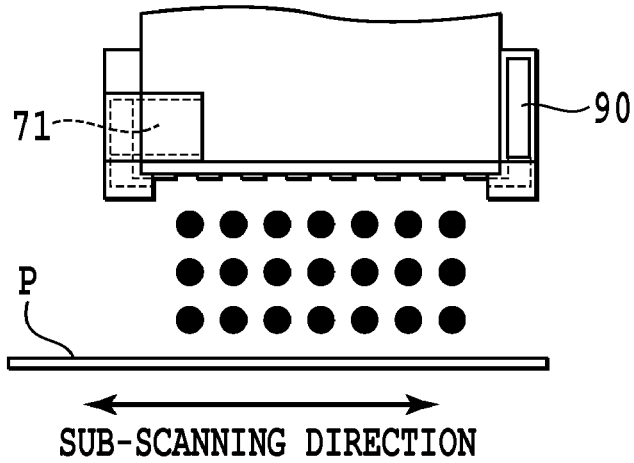

FIG. 8 is a block diagram illustrating the control configuration of the ink jet printing apparatus employed in this embodiment. An interface 1700 shown in FIG. 8 is provided to receive the image data sent from an external apparatus to the ink jet printing apparatus 1000. A MPU 1701 controls the entire apparatus. A ROM 1702 stores a control program executed by the MPU 1701. A DRAM 1703 stores various data (for example, the print signal and the print data supplied to the print head 1708). A gate array (G. A.) 1704 controls the supply of the print data to the print head 1708. The gate array 1704 also controls the data transfer among the interface 1700, the MPU 1701, and the DRAM 1703.

The carriage motor 5013 conveys the carriage HC on which the print head 1708 is mounted. The conveying motor 1709 conveys the print medium P in a direction that crosses the scanning direction of the carriage HC. A head driver 1705 is provided to drive the print head 1708. A motor driver 1706 is provided to drive the conveying motor 1706. A motor driver 1707 is provided to drive the carriage motor 5013.

The image data having been inputted into the interface 1700 is converted, between the gate array 1704 and the MPU 1701, into the print data corresponding to the ink colors that can be printed by the printing apparatus. Then, the motor drivers 1706 and 1707 are driven and the print head 1708 is driven by the head driver 1705 in accordance with the print data, and thus the printing is carried out.

Figure 12A:
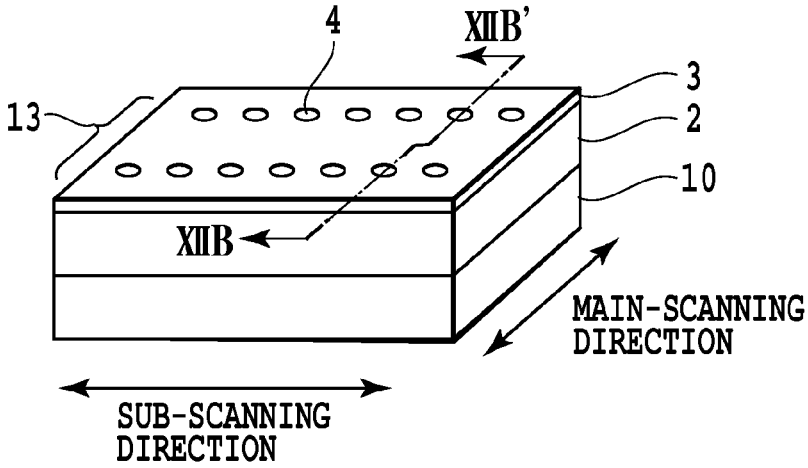
FIGS. 12A and 12B are schematic diagrams for describing the configurations of an ink-supply portion and of an ink-ejection portion of an ink jet print head 1708 employed in an embodiment of the present invention.
Figure 12B:
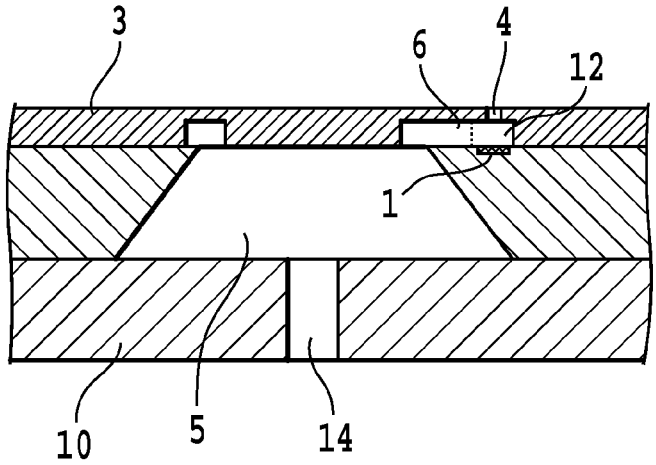

FIGS. 12A and 12B are schematic diagrams for describing the configurations of an ink-supply portion and of an ink-ejection portion of an ink jet print head 1708 employed in this embodiment. Note that the present invention is characterized by including gas blowing-out means for controlling the ejecting direction of ink-drop disposed near the ink-ejection portion. However, only the configurations of the ink-supply portion and the ink-ejection portion will be described for the moment. The detailed description for the gas blowing-out means will be given later for each of the Examples.

The ink jet print head 1708 of this embodiment includes an electrothermal transducing element (heater) as means for generating energy to eject the ink. The thermal energy generated in the electrothermal transducing element is used to cause a change in the state of the ink. To be more specific, voltage pulses are applied to the heaters provided at positions corresponding to the individual ejecting openings so as to cause film boiling of the ink that is in contact with the surface of the heater. Bubbles are generated and grow so as to generate pressure, by means of which a predetermined amount of ink is ejected, as ink drops, through the ejecting openings. In the ink jet print head 1708 with the above-mentioned configuration, the ejecting openings can be formed densely, and the ink drops can be ejected at relatively high frequency from the individual ejecting openings.

FIG. 12A shows ink-ejecting openings 4 to eject ink drops. The ink-ejecting openings 4 are formed in an orifice substrate 3, and are arranged in columns, at a predetermined pitch, in the sub-scanning direction. Two columns of the ejecting openings 4 form a single ejecting opening group 13. The ejecting openings 4 in one of the two ejecting opening columns are shifted from the ejecting openings 4 in the other of the two ejecting opening columns by a distance corresponding to a half of the pitch in the sub-scanning direction. The ink is ejected through the individual ejecting openings 4 while the print head 1708 is moving in the main-scanning direction. Thus, the image is printed in the sub-scanning direction at a double pitch of the predetermined pitch. The orifice substrate 3 is formed on an element substrate 2 that is formed on a support member 10.

FIG. 12B is a schematic diagram illustrating a cross section taken along the line 12B-12B' of FIG. 12A. A liquid passage to introduce the ink to the individual ejecting openings 4 are formed in the support member 10 and in the element substrate 2 that is formed on the support member 10. The ink that has been supplied from the ink tank IT through an ink supply opening 14 is stored once in a single supply chamber 5. The supply chamber 5 corresponds to the multiple ejecting openings 4 included in the single ejecting opening group 13. The ink then flows through ink paths 6 that are formed so as to correspond to the individual ejecting openings 4. The ink, then, reaches bubble forming chambers 12. A heater 1 that is an electrothermal transducing element is provided in each of the bubble forming chambers 12. With the bubble formation that takes place in each of the bubble forming chambers 12, a predetermined amount of ink is ejected, as ink drops, through each of the ink ejecting openings 4.

In this embodiment, the element substrate 2 is made of Si, but glass, ceramics, resin, or metal can be an alternative material. Though not illustrated in FIG. 12A or FIG. 12B, the heaters 1 and the wiring electrodes used to apply voltage to the heaters 1 are formed on the main surface of the element substrate 2. In addition, insulating film is formed so as to cover the heaters 1, and help the accumulated heat to be diffused. Moreover, protection films to protect the heaters 1 from the cavitations that take place when the air bubbles disappear are formed so as to cover the insulating films.

The orifice substrate 3 in which the ejecting openings 4 are formed is made, for example, of a metal as well as a polyimide resin, a polysulfone resin, and an epoxy resin. The bubble forming chambers 12 surrounding the heaters 1 and the ink passages 6 are formed by stacking the orifice substrate 3 at the position shown in FIGS. 12A and 12B with respect to the element substrate 2.

Note that the description that has been given above relates to the structure of only the portion supplying the ink of one kind to a single ejecting opening group 13 including two ejecting opening columns. The ink jet print head 1807 of this embodiment, however, includes other structures for ejecting inks of other kinds. Accordingly, plural ink supply openings 14 other than the above-mentioned one are provided at other positions in the support member 10 than the position shown in FIGS. 12A and 12B. While an element substrate 2 and an orifice substrate 3 are provided for each of the inks of different colors, and are bonded together, inks of different colors are supplied to the multiple element substrates 2 and the plural orifice substrates 3 through the corresponding ink supply openings 14.

A configuration of the print head characteristic of the present invention will be described below in detail by means of plural Examples. To put it differently, what will be described is the configuration of gas blowing-out means for controlling the ejecting direction by means of the ink jet printing apparatus and the print head descried above.

Example 1

Figure 1A:
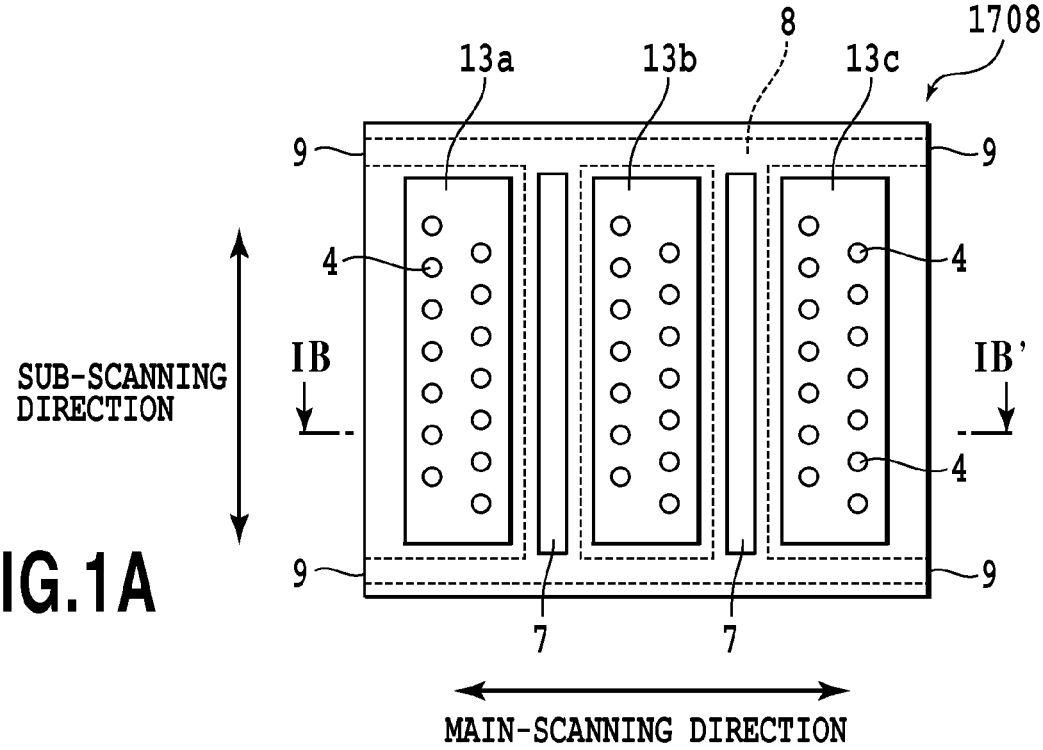
FIGS. 1A to 1C are schematic diagrams for describing the configuration of the ink jet print head used in Example 1 including: ejecting opening columns 13*a*, 13*b*, and 13*c* for three colors; gas blowing-out openings 7 provided nearby; and gas passage 8 for supplying gas to the gas blowing-out openings 7.
Figure 1B:
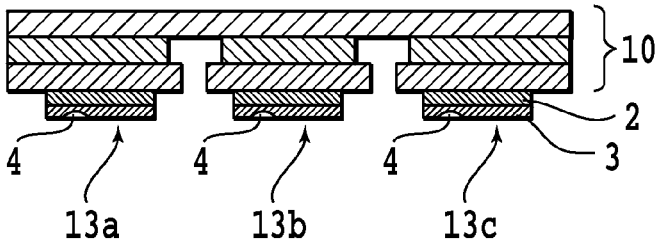
Figure 1C:
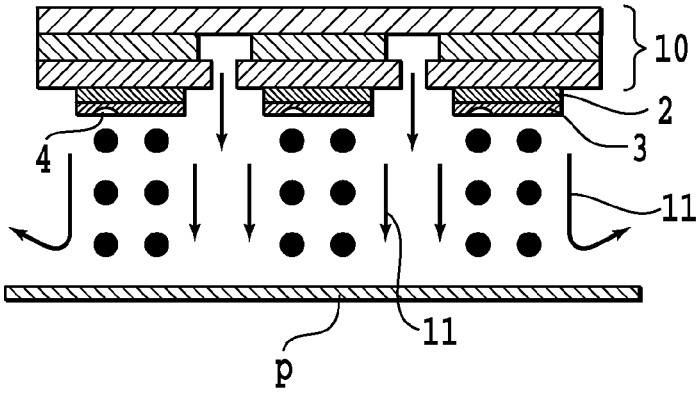

FIGS. 1A to 1C are schematic diagrams for describing the configuration of an ink jet print head used in Example 1 including: three ejecting opening groups 13*a*, 13*b*, and 13*c* respectively for three different colors; gas blowing-out openings 7 formed near the ejecting opening columns 13*a*, 13*b*, and 13*c*; and gas passage 8 for supplying gas to the gas blowing-out openings 7. FIG. 1A is a plan view of a print head 1708 seen from the side of the ejecting opening face. FIG. 1B is a cross sectional view taken along the line IB-IB' of FIG. 1A. FIG. 1C is a diagram for describing the state of air currents generated by the ejection of the ink from the ejecting opening groups 13*a* to 13*c* at the time of the printing.

In Example 1, three element substrates 2 are provided, and three orifice substrates 3 are formed respectively on the three element substrates 2. Sets of the orifice substrate 3 and the element substrate 2 are bonded to a single support member 10. The three ink ejecting opening groups 13*a* to 13*c* are formed respectively in the three orifice substrates 3 while each of the ejecting opening groups 13*a* to 13*c* includes two ejecting opening columns. Each of the ejecting opening columns includes multiple ejecting openings that are arranged in the sub-scanning direction at a pitch of 600 dpi (dots/inch), that is, at a pitch of approximately 42.3 μm. One of the two ejecting opening columns formed in each orifice substrate 3 is shifted from the other one in the sub-scanning direction by half a pitch (approximately 21.1 μm). The ejecting opening groups 13*a* to 13*c* thus formed enable the print head 1708 of Example 1 to print an image with a resolution of 1200 dpi in the sub-scanning direction. In each orifice substrate 3, the two ejecting opening columns are formed with a distance of 0.3 mm. The dimension on the longer side of each element substrate 2 is 28.4 mm while the dimension on the shorter side thereof is 0.8 mm. In addition, the element substrates 2 are provided so that each two element substrates 2 are separated by a center-to-center distance of 1.5 mm.

The gas blowing-out openings 7 are formed in the support member 10. Each of the gas blowing-out openings 7 is formed between two adjacent ones of the element substrates 2 so as to be parallel with the element substrates 2. The gas passage 8 is formed in the support member 10 both in its upper end portion and in its lower end portion. The gas passage 8 supplies the gas to both of the two gas blowing-out openings 7. The dimension of the each gas blowing-out opening 7 on the longer side is 30 mm while the dimension thereof on the shorter side is 0.4 mm.

FIG. 1C shows air currents 11 generated between the print head 1708 and a print medium P while the printing operation is being carried out. As the ejection frequency from each of the ejecting openings 4 increases, the air currents 11 become stronger and eventually come to interfere with one another. The examinations conducted by the inventors of the present invention revealed that the interference among the air currents 11 often becomes noticeable when the distance between adjacent ejecting opening groups (i.e., the distance between the each two adjacent element substrates 2) is shorter than double the distance between the ejecting opening face of the print head 1708 and the print medium P (i.e., the head-medium distance). In the printing apparatus of this embodiment, the head-medium distance is set at 1 mm, approximately. The 1.5-mm distance between ejecting opening groups in Example 1 is smaller than double the head-medium distance, that is, smaller than 2 mm. Accordingly, the action of ejecting ink from the three ejecting opening groups 13*a* to 13*c* results in greater interference among the air currents 11, and such greater interference may possibly cause the shifting of the landing positions of the ink drops, which results in an image of poorer quality.

In Example 1, while the print head 1708 is moving in the main-scanning direction for the printing operation, the air is introduced into the support member 10 from gas-introducing openings 9 located on the front side in the advancing direction of the support member 10. The air thus introduced passes through the gas passage 8, and is then blown out through the gas blowing-out openings 7. In this event, the gas is blown out in a direction that is perpendicular to the surface of the print medium P. Accordingly, the air currents 11 generated by the operation of ink ejection from the individual ejecting opening groups 13*a* to 13*c* can be reduced efficiently. In addition, each of the gas blowing-out openings 7 is formed with a length that is longer than each of the ejecting opening groups 13*a* to 13*c*. Accordingly, the influence of the air currents 11 can be reduced all along the area of the ejecting opening groups 13*a* to 13*c*, and the interference among the air currents 11 can be avoided. In short, the blowing out of the gas in parallel with the direction of ink ejection can reduce the influence of the gas itself thus ejected on the ink drops ejected from the ink-ejecting openings 4, and can reduce the generation of the air currents 11 between the ejecting opening groups 13*a* to 13*c*. As a consequence, according to Example 1, even when the printing of a high-resolution image of 1200 dpi is carried out at a high ejection frequency, the outputting of a uniform image is possible without any influence of the air currents 11.

Example 2

The printing head employed in Example 2 includes ejecting opening groups each of which is provided with a single column of ejecting openings for a single color. Such configuration of the printing head of Example 2 differs from the one that has been described above with reference to FIGS. 12A and 12B, as well as FIGS. 1A to 1C, that is, from the one including ejecting opening groups each of which is provided with two columns of ejecting openings.

Figure 2A:
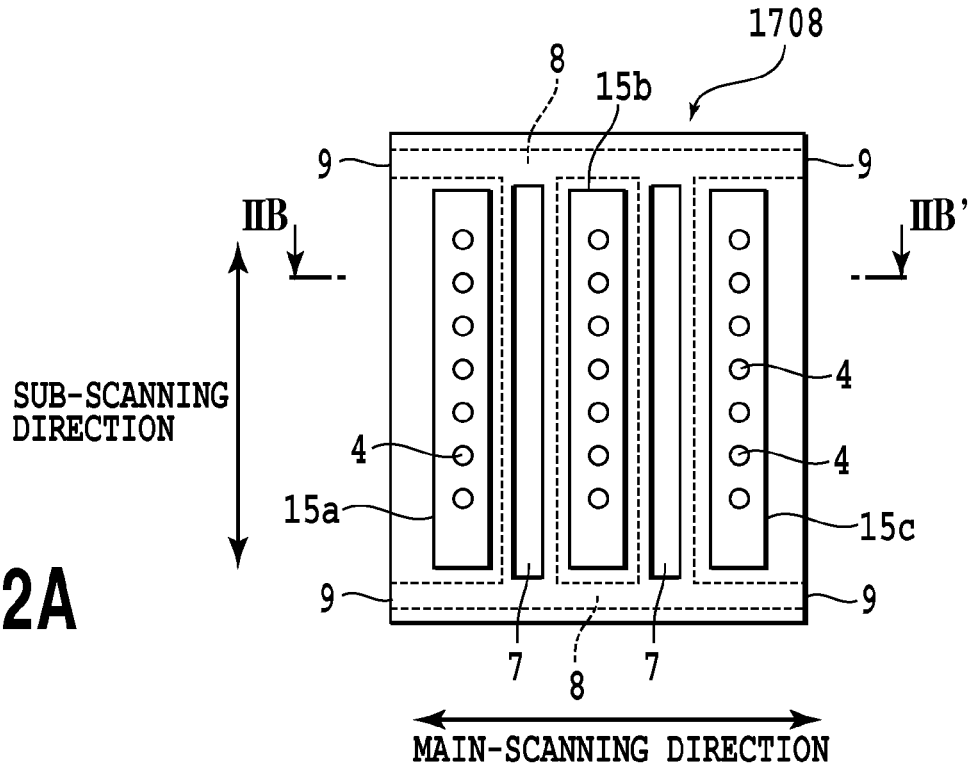
FIGS. 2A to 2C are diagrams for describing, in a similar way to the description for Example 1, the configuration of the ink jet print head used in Example 2 including: ejecting opening columns 15*a*, 15*b*, and 15*c* for three colors; gas blowing-out openings 7 provided nearby; and gas passage 8 for supplying gas to the gas blowing-out openings 7.
Figure 2B:
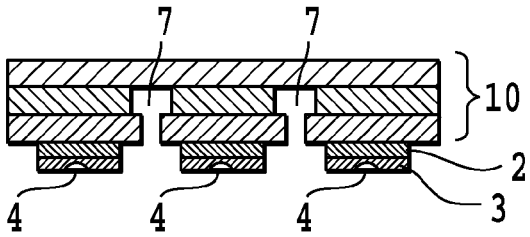
Figure 2C:
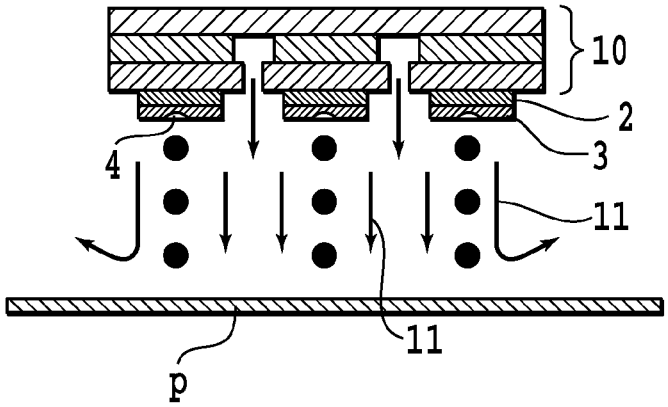

FIGS. 2A to 2C are diagrams for describing, in a similar way to the description given in Example 1 with reference to FIGS. 1A to 1C, the configuration of the ink jet print head used in Example 2 including: ejecting opening groups 15*a*, 15*b*, and 15*c* for three colors; gas blowing-out openings 7 provided nearby; and gas passage 8 for supplying gas to the gas blowing-out openings 7.

In Example 2, three element substrates 2 are provided, and three orifice substrates 3 are formed respectively on the three element substrates 2. Sets of the orifice substrate 3 and the element substrate 2 are bonded to a single support member 10. The three ink-ejecting opening groups 15*a* to 15*c* are formed respectively in the three orifice substrates 3 while each of the ink-ejecting opening groups 15*a* to 15*c* includes a single ejecting opening column. Each ejecting opening column includes multiple ejecting openings that are arranged in the sub-scanning direction at a pitch of 600 dpi (dots/inch), that is, at a pitch of approximately 42.3 μm. The ejecting opening groups 15*a* to 15*c* thus formed enable the print head 1708 of Example 2 to print an image with a resolution of 600 dpi in the sub-scanning direction. The dimension on the longer side of each element substrate 2 is 28.4 mm while the dimension on the shorter side thereof is 0.6 mm. In addition, the element substrates 2 are provided so that two element substrates 2 are separated by a center-to-center distance of 1.3 mm.

As in the case of Example 1, the gas blowing-out openings 7 are formed in the support member 10. Each of the gas blowing-out openings 7 is formed between two adjacent ones of the element substrates 2 so as to be parallel with the element substrates 2. The gas passage 8 is formed in the support member 10 both in its upper end portion and in its lower end portion. The gas passage 8 supplies the gas to both of the two gas blowing-out openings 7. The dimension of the each gas blowing-out opening 7 on the longer side is 30 mm while the dimension thereof on the shorter side is 0.4 mm.

The 1.3-mm distance between ejecting opening groups in Example 2 is also smaller than double the head-medium distance, that is, smaller than 2 mm. Accordingly, the operation of ejecting ink from the three ejecting opening groups 15*a* to 15*c* results in greater interference among the air currents 11, and such greater interference may possibly cause the shifting of the landing positions of the ink drops, which results in an image of poorer quality.

While the print head 1708 is moving in the main-scanning direction for the printing operation, the air is introduced into the support member 10 from gas-introducing openings 9 located on the side-end portion of the support member 10. The air thus introduced passes through the gas passage 8, and is then blown out through the gas blowing-out openings 7 in a direction that is perpendicular to the surface of the print medium P. Accordingly, the air currents 11 generated by the ink ejecting operation from the individual ejecting opening groups 15*a* to 15*c* can be reduced efficiently. As a consequence, the interference among the air currents 11 can be avoided. For this reason, even when the printing of a high-resolution image of 600 dpi is carried out at a high ejection frequency, the outputting of a uniform image is possible without any influence of the air currents 11.

Example 3

Example 3 differs from Example 1 described with reference to FIGS. 1A to 1C only in that the printing head employed in Example 3 has gas blowing-out openings 16 with a different shape.

FIGS. 3A and 3B are diagrams for describing, in a similar way to the description for Example 1, the configuration of the ink jet print head used in Example 3 including: ejecting opening groups 13*a*, 13*b*, and 13*c* for three colors; gas blowing-out openings 16 provided nearby; and gas passage 8 for supplying gas to the gas blowing-out openings 16. The gas blowing-out openings 16 of Example 3 differ from the gas blowing-out openings 7 of Example 1. While the width on the shorter side of each gas blowing-out opening 7 of Example 1 is 0.4 mm all along the length thereof, each of the gas blowing-out openings 16 of Example 3 has a shape with a width that is smaller than 0.4 mm at its end portions and a width that is larger than 0.4 mm at its central portion. In the case of the configuration shown in FIGS. 1A to 1C, in which the gas blowing-out opening 7 has a 30-mm dimension on its longitudinal side, a larger amount of gas tends to be blown out from the end portions that are located near the gas-introducing openings 9 than from the central portion that is located farther away from the gas-introducing openings 9. In the gas blowing-out opening 16 of Example 3, however, the area of the opening at each of the end portions is formed smaller and the area of the opening in the central portion is formed larger. Accordingly, the amount of gas blown out from the entire area of the gas blowing-out opening 16 can be adjusted almost uniformly.

Example 4

The print head employed in Example 4 differs from the one employed in Example 1 described with reference to FIGS. 1A to 1C in that gas passage 17 to introduce gas into the gas blowing-out openings 7 included in the print head of Example 4 has a different shape.

FIGS. 4A and 4B are diagrams for describing, in a similar way to the description for Example 1, the configuration of the ink jet print head used in Example 4 including: ejecting opening groups 13*a*, 13*b*, and 13*c* for three colors; gas blowing-out openings 7 provided nearby; and gas passage 17 for supplying gas to the gas blowing-out openings 7. Inside the gas passage 17 of Example 4, protruding portions 18 are formed at positions corresponding to the gas blowing-out openings 7. With this configuration, the protruding portions 18 formed at positions corresponding to the gas blowing-out openings 7 prevent the gas (air) introduced through gas-introducing openings 9 from advancing in a direction in which the gas passage 17 extends. As a consequence, the taking of the gas (air) into the gas blowing-out openings 7 is made easier by presence of the protruding portions 18. To put it differently, since the protruding portions may or may not be formed at any positions, and may be formed with different sizes, the amount of gas blown out from any one of the gas blowing-out openings 7 can be increased, or the two gas blowing-out openings 7 can be made to blow out gas of equal amount.

Example 5

The print head employed in Example 5 differs from the one employed in Example 1 described with reference to FIGS. 1A to 1C in that the print head of Example 5 has a different number of gas blowing-out openings 19 and the direction in which the gas blowing-out openings 19 of Example 5 are formed differs from the corresponding direction of Example 1.

Figure 5A:
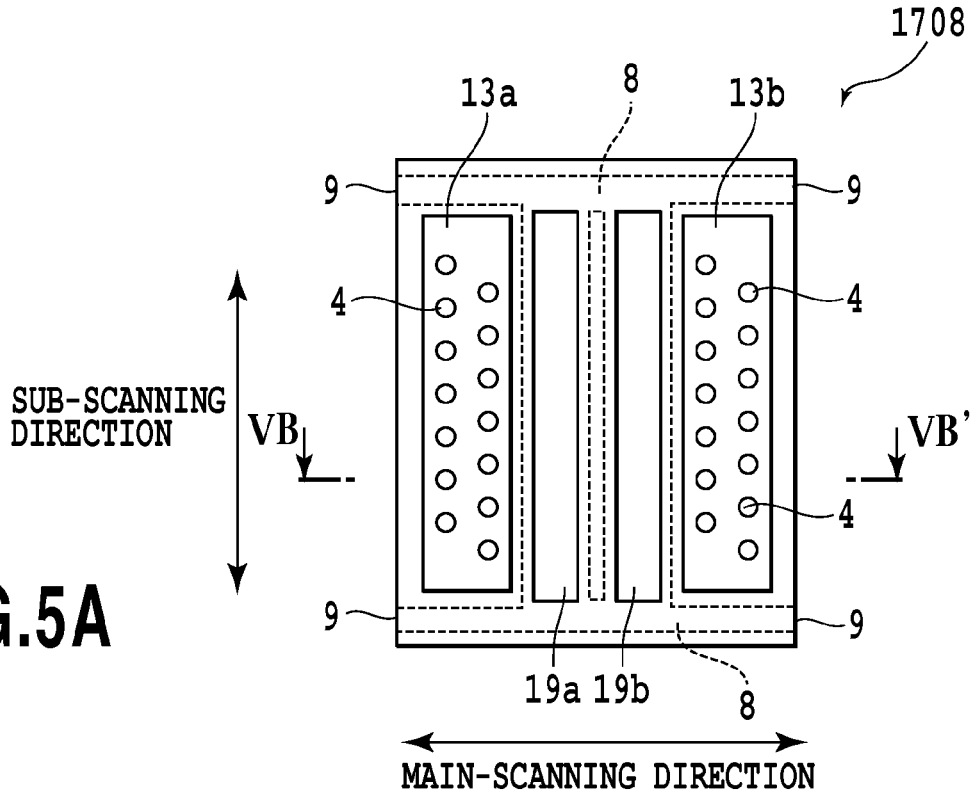
FIGS. 5A and 5B are diagrams for describing the configuration of the ink jet print head used in Example 5 including: ejecting opening columns 13*a* and 13*b* for two colors; two gas blowing-out openings 19*a* and 19*b* provided between the ejecting opening columns 13*a* and 13*b*; and gas passage 8 for supplying gas to the gas blowing-out openings 19*a* and 19*b;*
Figure 5B:
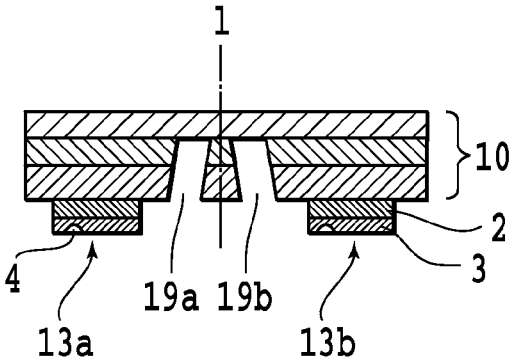

FIGS. 5A and 5B are diagrams for describing the configuration of the ink jet print head used in Example 5 including: ejecting opening groups 13*a* and 13*b* for two colors; two gas blowing-out openings 19*a* and 19*b* provided between the ejecting opening columns 13*a* and 13*b*; and gas passage 8 for supplying gas to the gas blowing-out openings 19*a* and 19*b*. Each of the gas blowing-out openings 19*a* and 19*b* of Example 5 has an opening portion with a longer-side dimension of 30 mm and a shorter-side dimension of 0.4 mm. As FIG. 5B shows, the gas blowing-out openings 19*a* and 19*b* are inclined so as to be symmetrical with each other with respect to a normal line l to the surface of the paper. By slightly inclining the gas blowing-out openings 19*a* and 19*b* in such a way, the gas introduced from gas-introducing openings 9 located on the side to which a print head 1708 is advancing can be blown out more smoothly through the gas blowing-out opening 19*a* or the gas blowing-out opening 19*b*. In Example 5, the two gas blowing-out openings 19*a* and 19*b* are formed symmetrically with each other. Accordingly, even when the print head performs two-way printing, the two gas blowing-out openings 19*a* and 19*b* prevent, in the forward scan and in the backward scan, the uneven state of blowing out of the gas introduced from the gas-introducing openings 9.

Example 6

The print head employed in Example 6 differs from the one employed in Example 1 described with reference to FIGS. 1A to 1C in that the print head of Example 6 has a simpler layered structure including a support member 10, element substrates 2, and orifice substrates 3.

FIGS. 6A and 6B are diagrams for describing, in a similar way to the description for Example 1, the configuration of the ink jet print head used in Example 6 including: ejecting opening groups 13*a*, 13*b*, and 13*c* for three colors; gas blowing-out openings 7 provided nearby; and gas passage 8 for supplying gas to the gas blowing-out opening 7.

In Example 6, a single element substrate 20 is bonded onto a single support member 10, and then a single orifice substrate 21 is bonded onto the element substrate 20 so as to form a layered structure. The gas blowing-out openings 7 are formed after the formation of the layered structure. With such a layered structure, the bonding of the element substrate 20 and the orifice substrate 21 to the support member 10 needs less accuracy than the accuracy needed in the examples described above. Accordingly, the print head 1708 of this embodiment can be manufactured by means of a manufacturing apparatus that is less expensive than otherwise.

Other Embodiments

The ink jet print head used in the description of the above-described embodiment is equipped with an electrothermal transducing element (heater) as means for generating energy to eject the ink. This is because, in the ink jet print head with such a configuration, the ejecting openings can be formed more densely and the ejection frequency for the individual ejecting openings can be set relatively high. Thus, the use of such an ink jet print head makes the problems of the present invention more noticeable, and the present invention is more likely to have effects. Such a configuration, however, should not be understood as a limitation for the present invention. The ink jet print head of the present invention may employ, as the means for generating energy, a piezoelectric element also know as a piezo element so as to eject ink by means of the deformation of the piezoelectric element caused when a voltage is applied to the piezoelectric element.

In addition, the gas passage of the print head in the embodiment described thus far changes the advancing direction of the air flow that is automatically introduced into the ink-introducing openings as the print head is moving. The air flow thus redirected advances in a direction that is perpendicular to the print medium. Under some conditions of printing operation performed by the printing head, however, the gas blowing out, utilizing the air flow in this way, may possibly be in an insufficient amount or at an insufficient speed. In this case, a gas blowing-out apparatus, such as a compressor, may be provided in the printing apparatus, on the carriage, or in the print head. Then, the air compressed by the gas blowing-out apparatus is blown out through the above-described gas-ejecting openings.

Moreover, when such a gas blowing-out apparatus is provided, the present invention can be applied not only to the above-described serial-type printing apparatuses, but also to full-line-type printing apparatuses in each of which the image is printed as the print medium is being moved with the print head being fixed to a certain position. Even when the print head is not moving, ejecting the ink drops with high density and at high frequency may possibly generate air currents and cause interference among the air currents thus generated, as in the above-described case of a serial-type printing apparatus. Even in this case, the position shift of the dots on the print medium can be avoided and a uniform image can be outputted. To this end, the compressed gas generated by the gas blowing-out apparatus is ejected near the ejecting opening groups and in a direction that is perpendicular to the print medium The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-317230, filed Dec. 7, 2007, which is hereby incorporated by reference herein in its entirety.

What is claimed is:

1. An ink jet print head comprising:

a plurality of ejecting opening groups arranged in a main-scanning direction that crosses a sub-scanning direction, each of the ejecting opening groups including ejecting openings which eject ink onto a print medium and which are arranged in the sub-scanning direction; and a gas blowing-out opening which is located between adjacent groups of said plurality of ejecting opening groups and which blows out gas in a direction parallel with the direction of the ink ejection.

2. The ink jet print head according to claim 1, further comprising:

ink paths for supplying ink respectively to the ejecting openings;

means for generating energy so as to eject ink from the ejecting openings; and a gas passage for supplying the gas to said gas blowing-out opening.

3. The ink jet print head according to claim 2, wherein air is introduced into said gas passage as the print head is moving in the main-scanning direction, and the air thus introduced is blown out through said gas blowing-out opening as the ink is being ejected.

4. The ink jet print head according to claim 3, wherein a protruding portion is formed in said gas passage so as to lead the gas to said gas blowing-out opening.

5. The ink jet print head according to claim 1, wherein a distance, in the main-scanning direction, between two adjacent groups of said plurality of ejecting opening groups is less than double the distance from the ejecting openings to the print medium.

6. The ink jet print head according to claim 1, wherein said gas blowing-out opening has a length, in the sub-scanning direction, which is equal to or greater than the length, in the sub-scanning direction, of said ejecting opening groups.

7. The ink jet print head according to claim 1, wherein said gas blowing-out opening has such a width in the main-scanning direction that the width is greater in the central portion thereof in the sub-scanning direction than in the end portions thereof in the sub-scanning direction.

8. An ink jet printing apparatus which prints an image on the print medium using the ink jet print head according to any one of claims 1 to 7.

9. The ink jet printing apparatus according to claim 8 comprising a gas blowing-out device for supplying gas to said gas blowing-out opening.

* * * * *